US011549282B2

(12) United States Patent
Martin et al.

(10) Patent No.: US 11,549,282 B2
(45) **Date of Patent: *Jan. 10, 2023**

(54) RIM STRIKE ASSEMBLY AND METHODS OF USE

(71) Applicant: CAMDEN MARKETING INC, Mississauga (CA)

(72) Inventors: Gary A. Martin, Orlando, FL (US); Jack Lewis, Mississauga (CA)

(73) Assignee: CAMDEN MARKETING INC

( * ) Notice: Subject to any disclaimer, the term of this patent is extended or adjusted under 35 U.S.C. 154(b) by 0 days.

This patent is subject to a terminal disclaimer.

(21) Appl. No.: 17/217,445

(22) Filed: Mar. 30, 2021

(65) Prior Publication Data

US 2021/0396047 A1 Dec. 23, 2021

Related U.S. Application Data

(63) Continuation of application No. 17/074,220, filed on Oct. 19, 2020, now Pat. No. 10,988,959.

(60) Provisional application No. 63/040,364, filed on Jun. 17, 2020.

(51) Int. Cl.
*E05B 47/00* (2006.01)
*E05B 47/02* (2006.01)

(52) U.S. Cl.
CPC ..... *E05B 47/0046* (2013.01); *E05B 47/0001* (2013.01); *E05B 2047/0024* (2013.01); *E05Y 2201/42* (2013.01); *E05Y 2201/434* (2013.01); *E05Y 2201/638* (2013.01); *E05Y 2900/132* (2013.01); *Y10T 292/696* (2015.04); *Y10T 292/699* (2015.04)

(58) Field of Classification Search
CPC ..... Y10T 292/696; Y10T 292/699; E05B 47/0046; E05B 47/0001
See application file for complete search history.

(56) References Cited

U.S. PATENT DOCUMENTS 2,613,097 A * 10/1952 Burnie ..... E05F 7/04 292/341.12
3,211,850 A * 10/1965 Toepfer ..... E05B 47/0047 200/61.64
3,521,921 A * 7/1970 Nagao ..... E05B 47/0047 292/201
3,640,560 A * 2/1972 Zawadzki ..... E05B 47/0047 292/341.16

(Continued)

*Primary Examiner* — Carlos Lugo
(74) *Attorney, Agent, or Firm* — Ewing & Jones, PLLC

(57) ABSTRACT

A rim strike assembly includes a strike body, strike jaw, retaining clutch, locking cam, locking clutch, and a solenoid. The strike jaw, retaining clutch, locking cam, and locking clutch are pivotably coupled to the strike body. The strike body and strike jaw define a latch cavity to receive a latch of a door. The strike jaw includes a jaw follower. The strike jaw is pivotable between a release position and a closed position. The retaining clutch engages the jaw follower and includes a retaining follower. The locking cam includes a retaining notch and a locking notch. The retaining follower engages the retaining notch. The locking clutch includes a locking follower that engages the locking notch of the locking cam. The solenoid includes a plunger coupled to the locking clutch such that movement of the plunger rotates the locking clutch from a locked position to an unlocked position.

19 Claims, 11 Drawing Sheets

(56) References Cited

U.S. PATENT DOCUMENTS

| | | | | | |
|---|---|---|---|---|---|
| 4,211,443 | A * | 7/1980 | Butts | E05B 47/0047 | 292/341.16 |
| 4,815,776 | A * | 3/1989 | Fuss | E05B 47/0047 | 292/341.16 |
| 4,948,184 | A * | 8/1990 | Weyerstall | E05B 83/36 | 292/201 |
| 4,978,153 | A * | 12/1990 | Hirsch | B04B 7/06 | 292/201 |
| 5,690,373 | A * | 11/1997 | Luker | E05B 63/0065 | 292/201 |
| 6,390,520 | B1 * | 5/2002 | Holzer | E05B 47/0046 | 292/341.16 |
| 7,021,684 | B2 * | 4/2006 | Orbeta | E05B 47/0046 | 292/201 |
| 8,047,585 | B1 * | 11/2011 | Peabody | E05B 47/0046 | 292/341.16 |
| 8,096,594 | B2 * | 1/2012 | Uyeda | E05B 47/0046 | 292/341.15 |
| 8,454,063 | B2 * | 6/2013 | David | E05B 47/0046 | 292/341.16 |
| 9,617,755 | B2 * | 4/2017 | Peabody | E05B 15/022 | |
| 9,702,167 | B2 * | 7/2017 | Liao | E05B 47/0046 | |
| 10,988,959 | B1 * | 4/2021 | Martin | E05B 47/0046 | |
| 2015/0308167 | A1 * | 10/2015 | Chang | E05B 47/0607 | 292/214 |

* cited by examiner

RIM STRIKE ASSEMBLY AND METHODS OF USE

CROSS-REFERENCE TO RELATED APPLICATIONS

This application is a continuation of and claims priority to U.S. nonprovisional application Ser. No. 17/074,220, filed Oct. 19, 2020, which itself claims priority from U.S. provisional application No. 63/040,364, filed Jun. 17, 2020, each of which is hereby incorporated by reference herein in its entirety.

TECHNICAL FIELD/FIELD OF THE DISCLOSURE

The present disclosure relates generally to access control devices, and specifically to electric strikes for door assemblies.

BACKGROUND OF THE DISCLOSURE

Crash bars, also known as panic bars, push bars, and panic exit devices, are mechanisms that allow the unlatching and opening of a door by pressing on a bar or other device in the same direction that the door opens. Such operation may allow for safer or more convenient operation for a user traveling from the inside of a room or building to the exterior in a case where the door swings outward. The side of the door to which the crash bar is mounted is referred to herein as the inside of the door. Unlatching the door from the outside of the door, defined herein as the side of the door opposite the inside of the door, is typically either disallowed by a lack of door trim on the outside of the door or is accomplished by the rotation of a knob or lever or by the actuation of an electric strike. An electric strike may engage the latch of the crash bar, allowing the door to be selectively locked or unlocked from the outside depending on whether the electric strike is electrically energized or not. Force exerted on the electric strike by the door, referred to herein as preload, may interfere with the ability of the electric strike to operate properly.

SUMMARY

The present disclosure provides for a rim strike assembly. The rim strike assembly may include a strike body. The rim strike assembly may include a strike jaw. The strike jaw may be pivotably coupled to the strike body. The strike body and strike jaw may define a latch cavity. The strike jaw may include a jaw follower. The strike jaw may be pivotable between a release position and a closed position. The rim strike assembly may include a retaining clutch pivotably coupled to the strike body, the retaining clutch engaging the jaw follower. The retaining clutch may include a retaining follower. The rim strike assembly may include a locking cam pivotably coupled to the strike body. The locking cam may include a retaining notch and a locking notch. The retaining follower may engage the retaining notch. The rim strike assembly may include a locking clutch pivotably coupled to the strike body. The locking clutch may include a locking follower. The locking follower may engage the locking notch of the locking cam. The rim strike assembly may include a solenoid. The solenoid may include a plunger coupled to the locking clutch such that movement of the plunger rotates the locking clutch from a locked position to an unlocked position.

The present disclosure also provides for a system. The system may include a door, the door including a latch. The system may include a rim strike assembly coupled to a doorjamb. The rim strike assembly may be positioned to receive the latch when the door is closed. The rim strike assembly may include a strike body. The rim strike assembly may include a strike jaw. The strike jaw may be pivotably coupled to the strike body. The strike body and strike jaw may define a latch cavity. The strike jaw may include a jaw follower. The strike jaw may be pivotable between a release position and a closed position. The rim strike assembly may include a retaining clutch pivotably coupled to the strike body, the retaining clutch engaging the jaw follower. The retaining clutch may include a retaining follower. The rim strike assembly may include a locking cam pivotably coupled to the strike body. The locking cam may include a retaining notch and a locking notch. The retaining follower may engage the retaining notch. The rim strike assembly may include a locking clutch pivotably coupled to the strike body. The locking clutch may include a locking follower. The locking follower may engage the locking notch of the locking cam. The rim strike assembly may include a solenoid. The solenoid may include a plunger coupled to the locking clutch such that movement of the plunger rotates the locking clutch from a locked position to an unlocked position.

The present disclosure also provides for a method. The method may include coupling a rim strike assembly to a door jamb. The rim strike assembly may be positioned to receive a latch of a door. The rim strike assembly may include a strike body. The rim strike assembly may include a strike jaw pivotably coupled to the strike body. The strike body and strike jaw may define a latch cavity. The strike jaw may include a jaw follower. The strike jaw may be pivotable between a release position and a closed position. The rim strike assembly may include a retaining clutch pivotably coupled to the strike body. The retaining clutch may engage the jaw follower. The retaining clutch may include a retaining follower. The rim strike assembly may include a locking cam pivotably coupled to the strike body. The locking cam may include a retaining notch and a locking notch. The retaining follower may engage the retaining notch. The rim strike assembly may include a locking clutch pivotably coupled to the strike body. The locking clutch may include a locking follower. The locking follower may engage the locking notch of the locking cam. The rim strike assembly may include a solenoid. The solenoid may include a plunger coupled to the locking clutch such that movement of the plunger rotates the locking clutch from a locked position to an unlocked position. The method may include closing the door such that the latch enters the latch cavity, applying an opening force to the strike jaw through the latch, engaging the jaw follower to the retaining clutch, engaging the retaining follower to the locking cam, and engaging the locking follower with the locking clutch.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
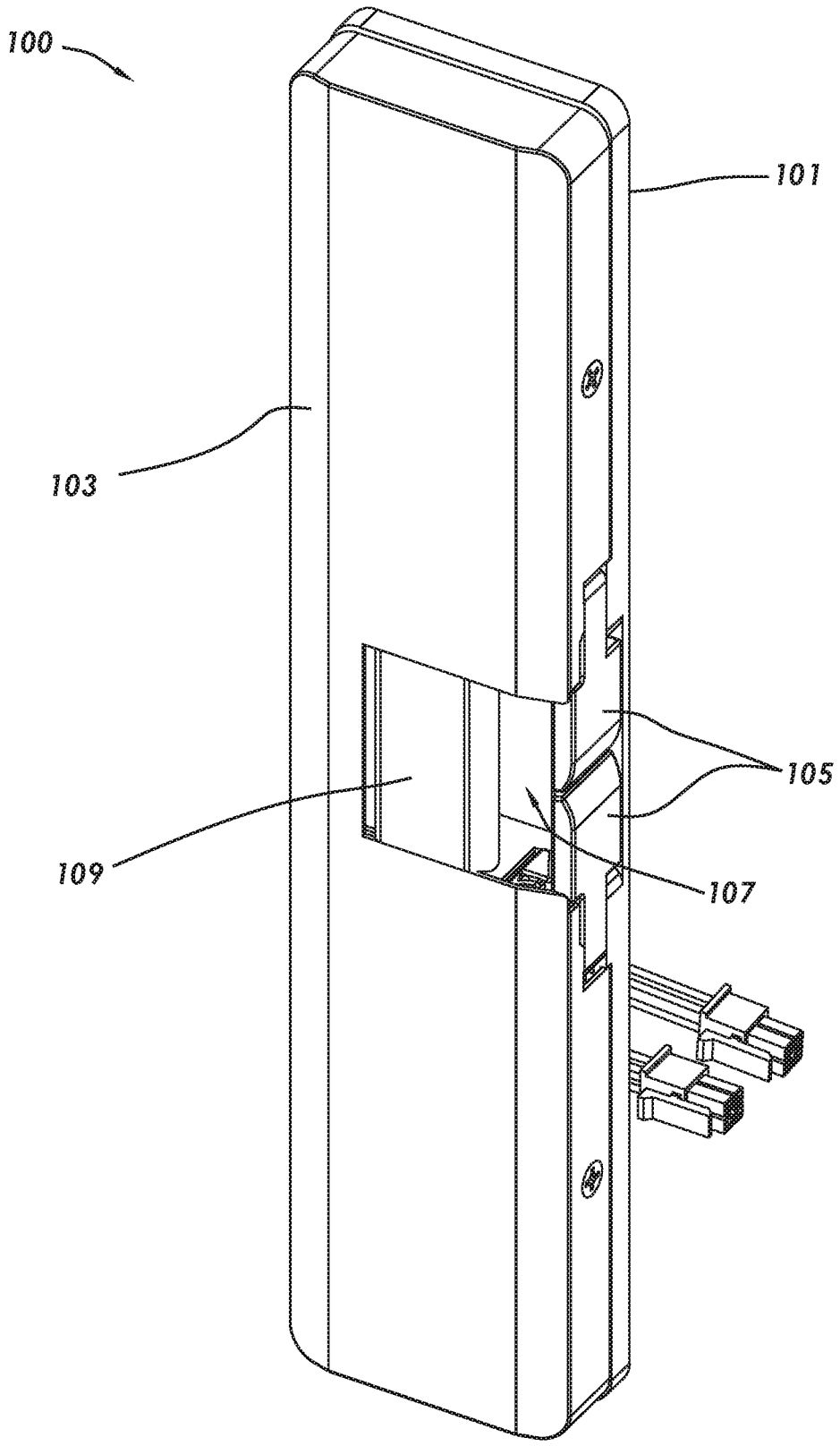
FIG. 1 depicts a perspective view of a rim strike assembly consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

Figure 2:
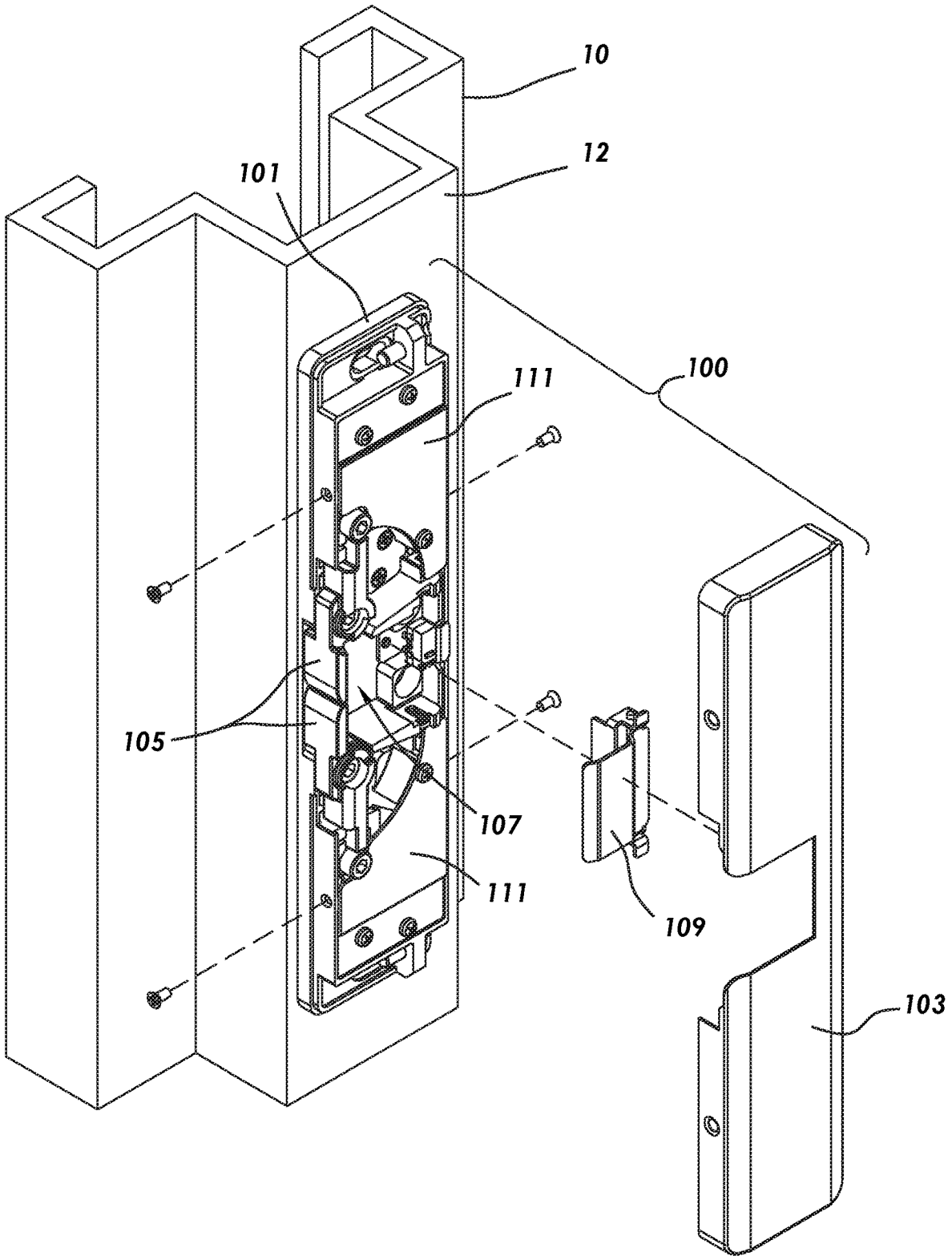
FIG. 2 depicts an exploded view of a rim strike assembly consistent with at least one embodiment of the present disclosure.

FIGS. 1 and 2 depict rim strike assembly 100. Rim strike assembly 100 may include strike body 101 and outer cover 103. Rim strike assembly 100 may include one or more strike jaws 105. Strike body 101 and outer cover 103 may include a cutout, defined as latch cavity 107. Strike jaws 105 may define a sidewall of latch cavity 107. For the purposes of this disclosure, the term "inward" is defined as a direction relative to latch cavity 107 toward strike jaws 105, and "outward" is defined as the direction opposite the "inward" direction.

Figure 3:
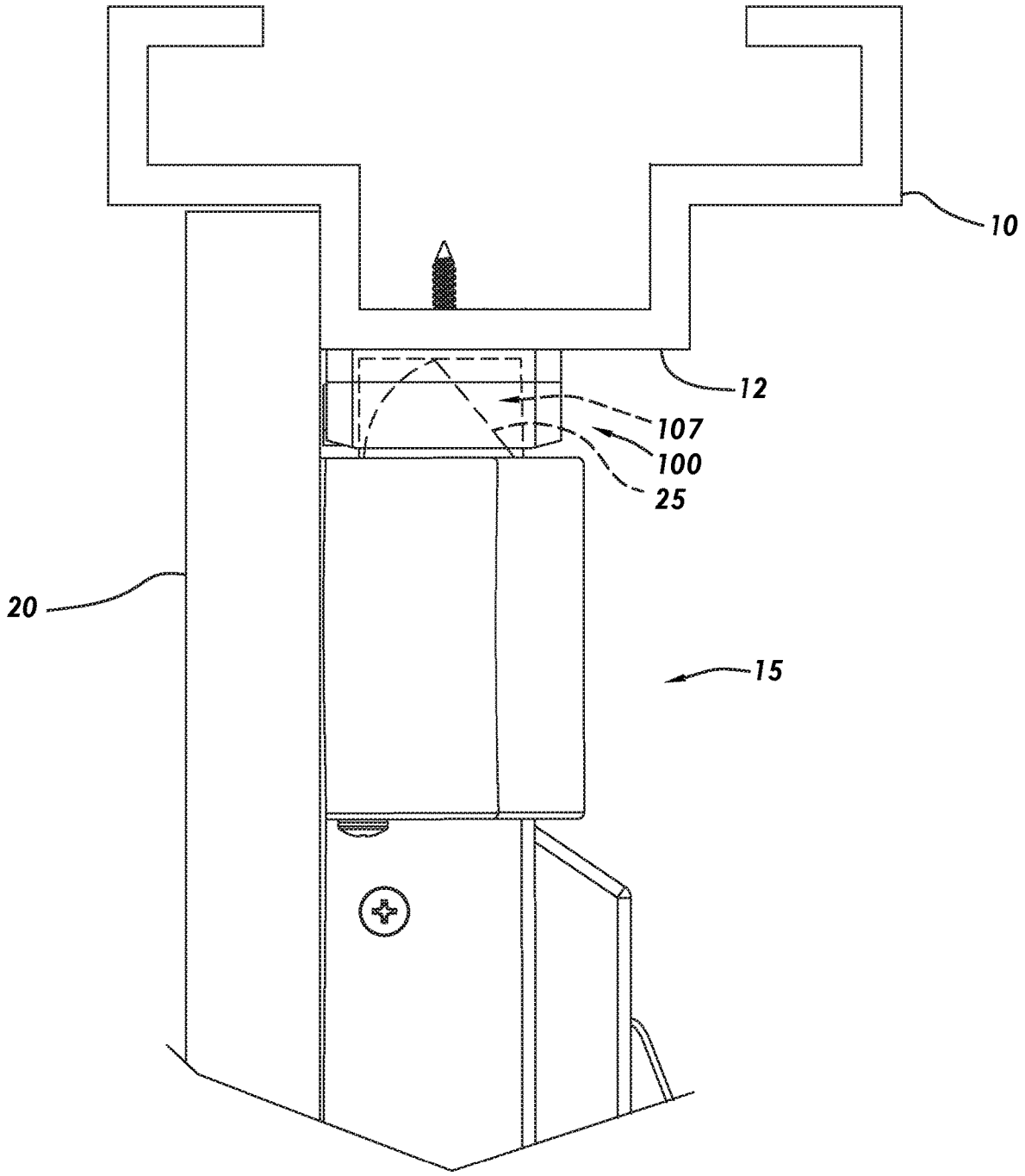
FIG. 3 depicts a partial top view of a door assembly including a rim strike assembly consistent with at least one embodiment of the present disclosure.

As shown in FIG. 3, rim strike assembly 100 may, in some embodiments, be installed to door jamb 10 at a position aligned with crash bar 15 mounted on door 20. In some embodiments, rim strike assembly 100 may be installed to soffit 12 of door jamb 10. Rim strike assembly 100 may be positioned such that latch 25 of crash bar 15 enters latch cavity 107 when door 20 is in the closed position. As door 20 closes, latch 25 contacts strike jaws 105 of rim strike assembly 100 and retracts into crash bar 15 until latch 25 clears strike jaws 105, at which point latch 25 is extended into latch cavity 107. When rim strike assembly 100 is in the locked position and an opening force is applied to door 20 without actuation of crash bar 15, strike jaws 105 are held in place as further discussed below, and strike jaws 105 restrict movement of latch 25 out of latch cavity 107, thereby maintaining door 20 in the closed position. The opening force applied against strike jaws 105 while rim strike assembly 100 is in the locked position is referred to herein as preload. When rim strike assembly 100 is unlocked, strike jaws 105 may be pivoted by the opening force applied to door 20 as it is transferred to strike jaws 105 by latch 25 as further discussed below.

In some embodiments, as shown in FIGS. 1 and 2, rim strike assembly 100 may include latch monitor paddle 109 positioned within latch cavity 107. In such an embodiment, latch monitor paddle 109 may be pivotably coupled to strike body 101 such that latch monitor paddle 109 is movable between an extended and retracted position. In some embodiments, latch monitor paddle 109 may be biased toward the extended position by, for example and without limitation, a spring. Latch monitor paddle 109 may be moved to the retracted position by latch 25 when door 20 is in the closed position. In some embodiments, rim strike assembly 100 may include an electric switch positioned to detect the position of latch monitor paddle 109. By detecting the position of latch monitor paddle 109, rim strike assembly 100 may thereby provide an electric signal to an external operator or device to indicate whether door 20 is in a secure position in which latch 25 is positioned within latch cavity 107. With such information, it can be determined whether door 20 is in the closed position or is in an open or otherwise insecure position, such as where latch 25 is dogged to an unlatched position.

In some embodiments, as shown in FIG. 2, rim strike assembly 100 may include one or more inner covers 111.

Figure 4:
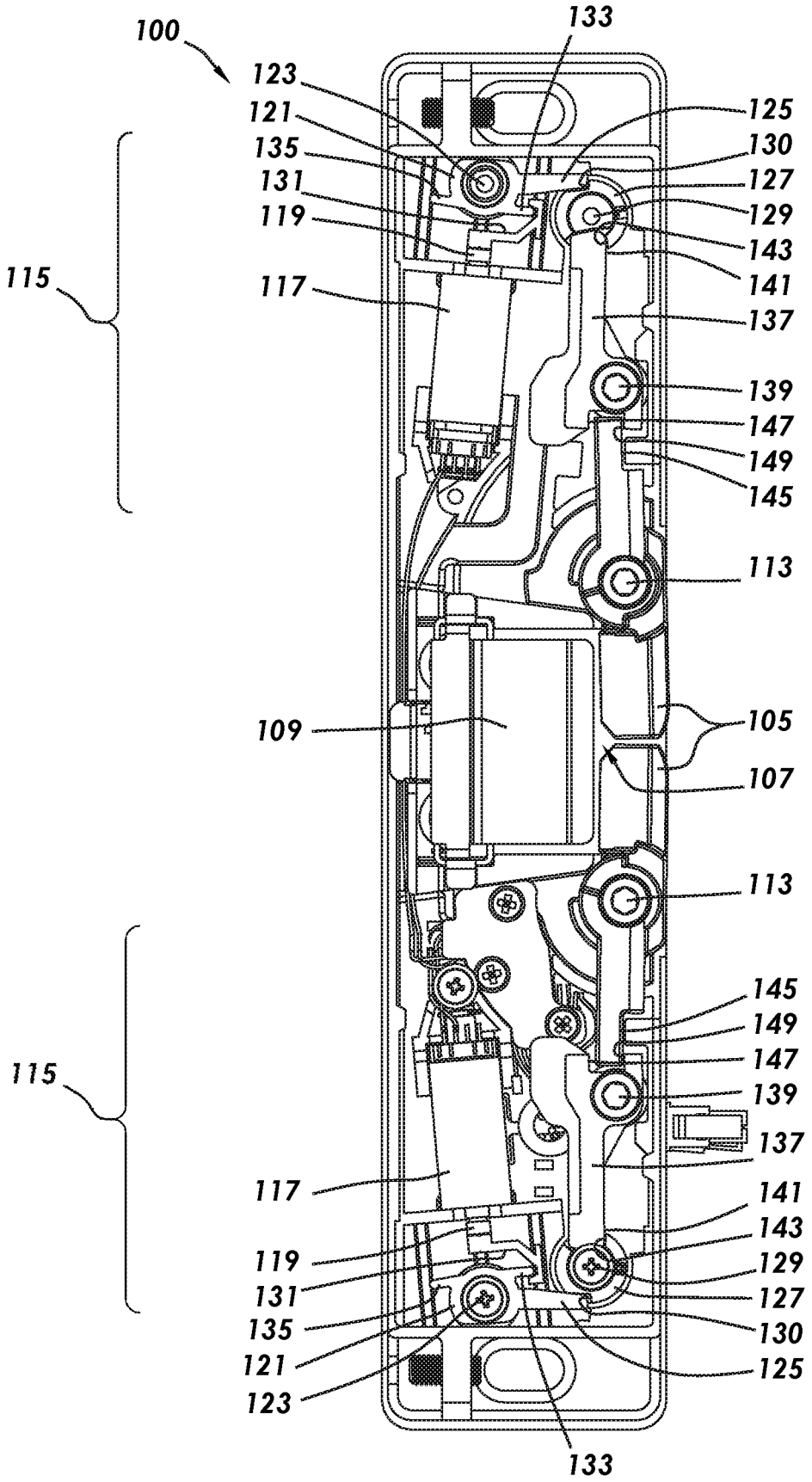
FIG. 4 depicts an elevation view of a partially disassembled rim strike assembly consistent with at least one embodiment of the present disclosure.

FIG. 4 depicts an elevation view of rim strike assembly 100 with outer cover 103 and inner covers 111 removed. In some embodiments, each strike jaw 105 may be pivotably coupled to strike body 101 by a respective jaw pivot pin 113. The term "pivot pin" as used herein includes any structure adapted to allow the pivoting of the associated structure including, for example and without limitation, an extrusion, upset, detent, wire, or threaded fastener such as a screw or bolt. Control over the ability of each strike jaw 105 to pivot relative to strike body 101 may be controlled by a respective actuation linkage assembly 115. In some embodiments, each strike jaw 105 may be biased into the closed position by, for example and without limitation, a spring. In some embodiments, each actuation linkage assembly 115 may be substantially identical and may be operated simultaneously by a single electrical input to rim strike assembly 100. For the purposes of the following discussion, a single actuation linkage assembly 115 is discussed. One of ordinary skill in the art with the benefit of this disclosure understands that although two strike jaws 105 and two associated actuation linkage assemblies 115 are shown, certain embodiments of the present disclosure operate with a single strike jaw 105 and associated actuation linkage assembly.

In some embodiments, each actuation linkage assembly 115 may include solenoid 117. Solenoid 117 may be mechanically coupled to strike body 101. Solenoid 117 may be an alternating current or direct current electromechanical solenoid. Solenoid 117 may act to extend plunger 119 when solenoid 117 is electrically energized. In some embodiments, plunger 119 may be biased to a retracted position when solenoid 117 is not electrically energized by, for example and without limitation, a spring.

In some embodiments, actuation linkage assembly 115 may include locking clutch 121. Locking clutch 121, shown in detail in FIGS. 5 and 6, may be pivotably coupled to strike body 101 by locking clutch pivot pin 123. Locking clutch 121 may include locking follower 125. Locking follower 125 may be an extension of locking clutch 121 that extends generally in a radial direction away from locking clutch pivot pin 123. In some embodiments, locking follower 125 may be offset from a ray extending from locking clutch pivot pin 123. Locking follower 125 may engage locking cam 127. Locking cam 127 may be pivotably coupled to strike body 101 at locking cam pivot pin 129. Locking cam 127 may include locking notch 130 positioned to, when engaged to locking follower 125, retard rotation of locking cam 127 as further described below. In some embodiments, locking clutch 121 may pivot between a locked position (shown in FIG. 5) in which locking follower 125 is engaged to locking cam 127 and an unlocked position (shown in FIG. 6) in which locking follower 125 is disengaged from locking cam 127.

In some embodiments, locking clutch 121 may be moved between the locked position and the unlocked position by the operation of solenoid 117. In some embodiments, locking clutch 121 may be operatively mechanically coupled to plunger 119.

In some such embodiments, plunger 119 may move locking clutch 121 between the locked position and the unlocked position using control horn 131. Control horn 131 may be mechanically coupled to plunger 119 and may engage locking clutch 121. In some embodiments, control horn 131 may engage locking clutch 121 such that control horn 131 may pivot control horn 131 both when plunger 119 extends and retracts.

In some embodiments, control horn 131 may engage locking clutch 121 such that locking clutch 121 is in the locked position when solenoid 117 is not electrically energized and in the unlocked position when solenoid 117 is electrically energized. Such a configuration is depicted in detail in FIG. 4A and is referred to herein as a "fail-secure" configuration of rim strike assembly 100. In such a configuration, rim strike assembly 100 is locked when no electrical power is supplied to solenoid 117 and is unlocked when electrical power is supplied to solenoid 117.

In some embodiments, control horn 131 may engage locking clutch 121 such that locking clutch 121 is in the unlocked position when solenoid 117 is not electrically energized and in the locked position when solenoid 117 is electrically energized. Such a configuration is depicted in detail in FIG. 4B and is referred to herein as a "fail-safe" configuration of rim strike assembly 100. In such a configuration, rim strike assembly 100 is locked when electrical power is supplied to solenoid 117 and is unlocked when no electrical power is supplied to solenoid 117.

In some embodiments, control horn 131 may be rotatably coupled to plunger 119 such that the fail-secure and fail-safe configurations may be selected by a user by rotating control horn 131 relative to plunger 119. In such an embodiment, locking clutch 121 may include fail-secure actuating pin 133 and fail-safe actuating pin 135 located on opposite sides of locking clutch pivot pin 123 such that direction in which locking clutch 121 is rotated in response to the extension and retraction of plunger 119 is modified by the positioning of control horn 131, thereby allowing the fail-secure and fail-safe configurations to be selected without otherwise modifying rim strike assembly 100. Operation of rim strike assembly 100 in either the fail-secure or fail-safe configuration is substantially identical, except for the need to energize or deenergize solenoid 117 to unlock rim strike assembly 100.

In some embodiments, actuation linkage assembly 115 may include retaining clutch 137. Retaining clutch 137 may be pivotably coupled to strike body 101 by retaining clutch pivot pin 139. In some embodiments, retaining clutch 137 may include retaining follower 141. Retaining follower 141 may be an extension of retaining clutch 137 that extends generally in a radial direction away from retaining clutch pivot pin 139. In some embodiments, retaining follower 141 may be offset from a ray extending from retaining clutch pivot pin 139. Retaining follower 141 may engage locking cam 127. In some embodiments, retaining follower 141 may engage retaining notch 143 of locking cam 127 and may rotate locking cam 127 as retaining clutch 137 pivots between a retention position and a release position as further described below. The ability of locking cam 127 to rotate and thereby the ability of retaining clutch 137 to pivot between the retention position and the release position may be controlled, as discussed above, by the position of locking clutch 121.

In some embodiments, retaining clutch 137 may engage strike jaw 105. In such an embodiment, strike jaw 105 may include jaw follower 145, and retaining clutch 137 may include retention face 147 and reset face 149. Jaw follower 145 may be an extension of strike jaw 105 that extends generally in a radial direction away from jaw pivot pin 113. In some embodiments, jaw follower 145 may be offset from a ray extending from jaw pivot pin 113. Retention face 147 and reset face 149 may be positioned to face each other such that jaw follower 145 is positioned therebetween when strike jaw 105 is in the closed position. Retention face 147 may be positioned such that an opening force or preload applied to strike jaw 105 brings jaw follower 145 into contact with retention face 147. Reset face 149 may be positioned such that the force applied to strike jaw 105 to bias strike jaw 105 into the closed position brings jaw follower 145 into contact with reset face 149. Jaw follower 145 may, during operation of rim strike assembly 100, engage retention face 147 and reset face 149 of retaining clutch 137, as further described below, such that pivoting forces are applied to retaining clutch 137.

In some embodiments, retaining clutch 137 may be configured such that retaining follower 141 may engage locking cam 127 at a distance that is further away from retaining clutch pivot pin 139 than retention face 147. Without being bound to theory, in such an embodiment, because the moment arm of retaining follower 141 is longer, the force applied between jaw follower 145 and reset face 149 is higher than the force applied between retaining follower 141 and locking cam 127, and thereby the moment of force on locking cam 127 is lower than the moment of force applied to strike jaw 105. By reducing the moment of force on locking cam 127, the force required to move locking clutch 121 from the locked position to the unlocked position may be reduced as compared to an arrangement in which locking clutch 121 acts on strike jaw 105 directly. Without being bound to theory, this reduction in transferred force may, for example and without limitation, allow rim strike assembly 100 to unlock while exposed to a higher preload than a rim strike that does not include a reduction in transferred force using actuation linkage assembly 115.

Figure 4A:
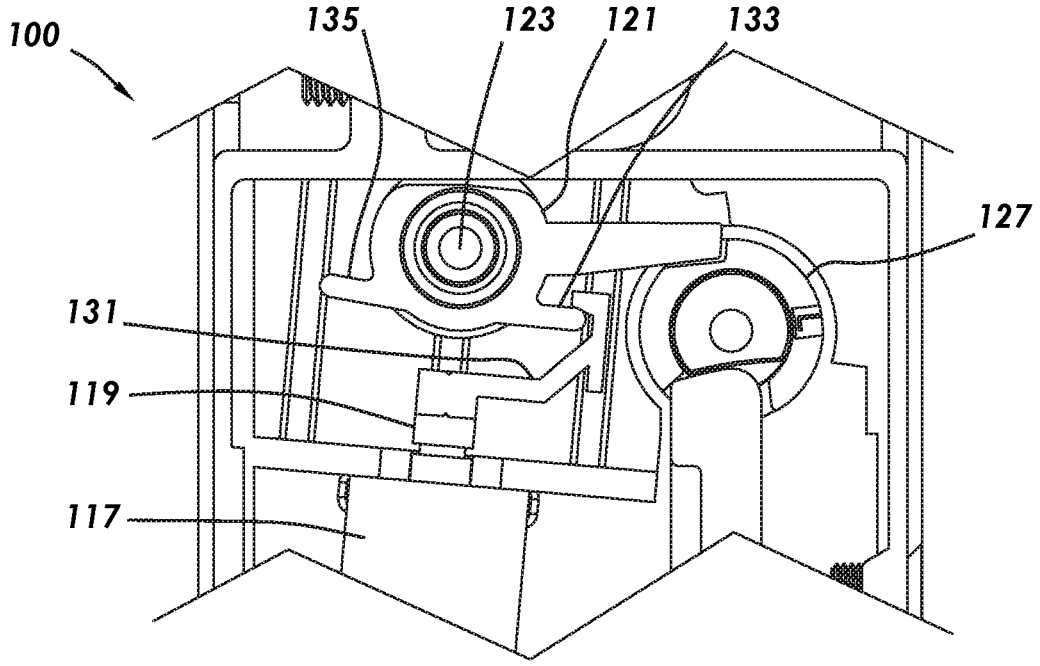
FIG. 4A depicts a detail elevation view of the rim strike assembly of FIG. 4 in a fail-secure configuration.
Figure 4B:
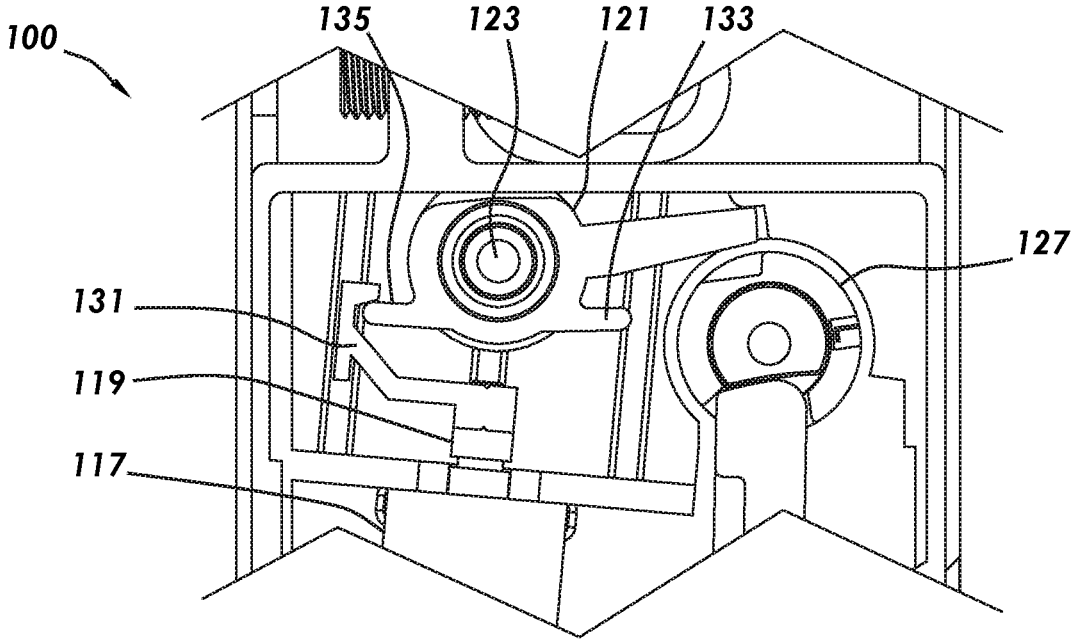
FIG. 4B depicts a detail elevation view of the rim strike assembly of FIG. 4 in a fail-safe configuration.

As an example, FIG. 4 depicts rim strike assembly 100 in the locked configuration. FIGS. 4 and 4A depict rim strike assembly 100 in the fail-secure configuration, and therefore solenoid 117 is not electrically energized. (If rim strike assembly 100 were in the fail-safe configuration as shown in FIG. 4B, solenoid 117 would be electrically actuated to put rim strike assembly 100 in the locked configuration.)

Figure 5:
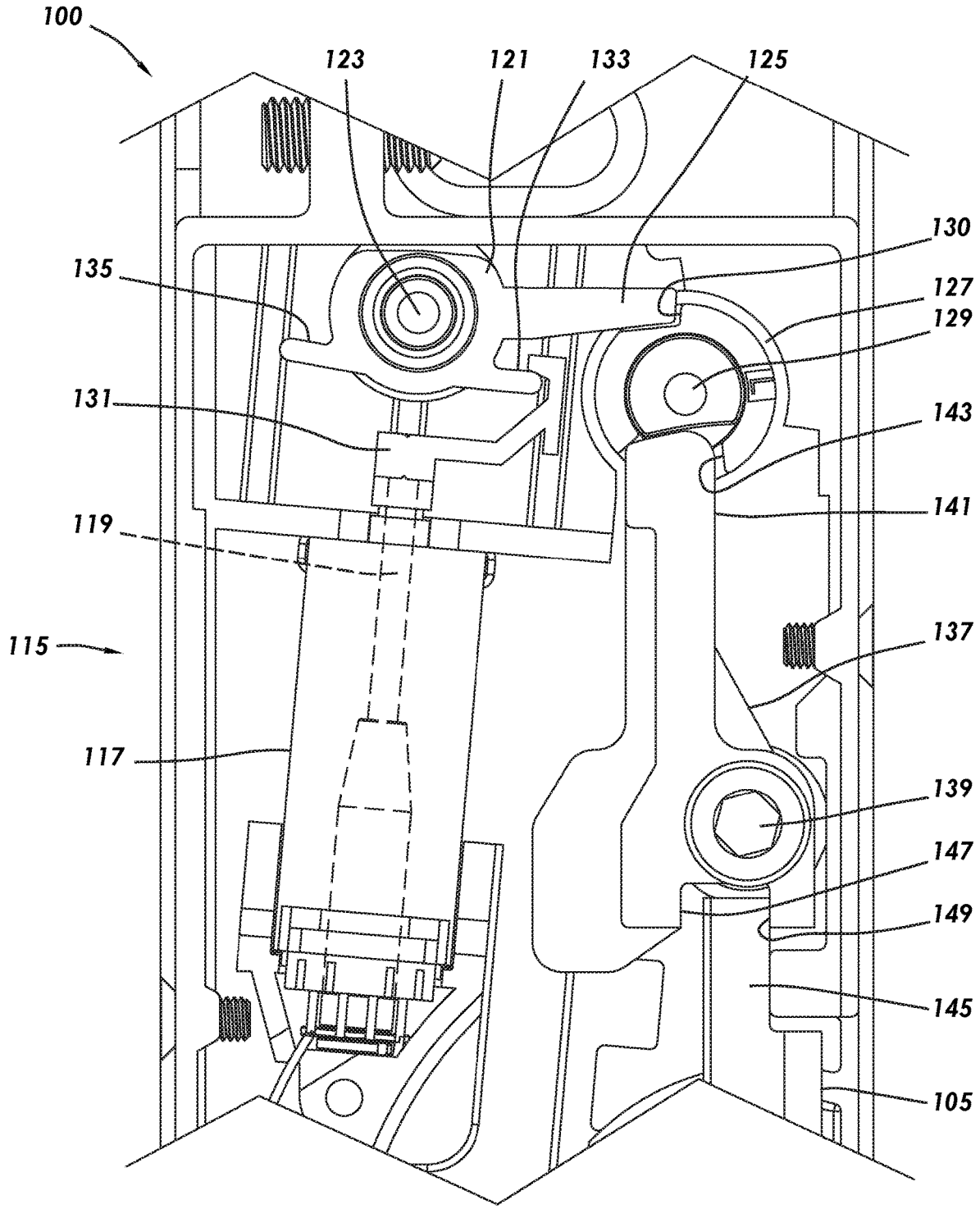
FIG. 5 depicts a detail view of a rim strike assembly consistent with at least one embodiment of the present disclosure in a locked position.

When rim strike assembly 100 is in the locked configuration, locking clutch 121 is in the locked position as shown in detail in FIG. 5. In this position, locking follower 125 is engaged to locking notch 130 of locking cam 127.

When an opening force is applied to strike jaw 105, such as by latch 25 of crash bar 15 in a situation in which an attempt to open door 20 is made without actuation of crash bar 15, jaw follower 145 may engage retention face 147 of retaining clutch 137. The moment of force applied to strike jaw 105 is thereby transferred to retaining clutch 137, which in turn is transferred to locking cam 127 by retaining follower 141. However, because locking follower 125 is engaged to locking notch 130 of locking cam 127, locking cam 127 is retarded from rotation, and therefore further pivoting of strike jaw 105 is also retarded. Thus, strike jaw 105 is maintained in the closed position, latch 25 is unable to exit latch cavity 107, and door 20 remains closed.

Figure 6:
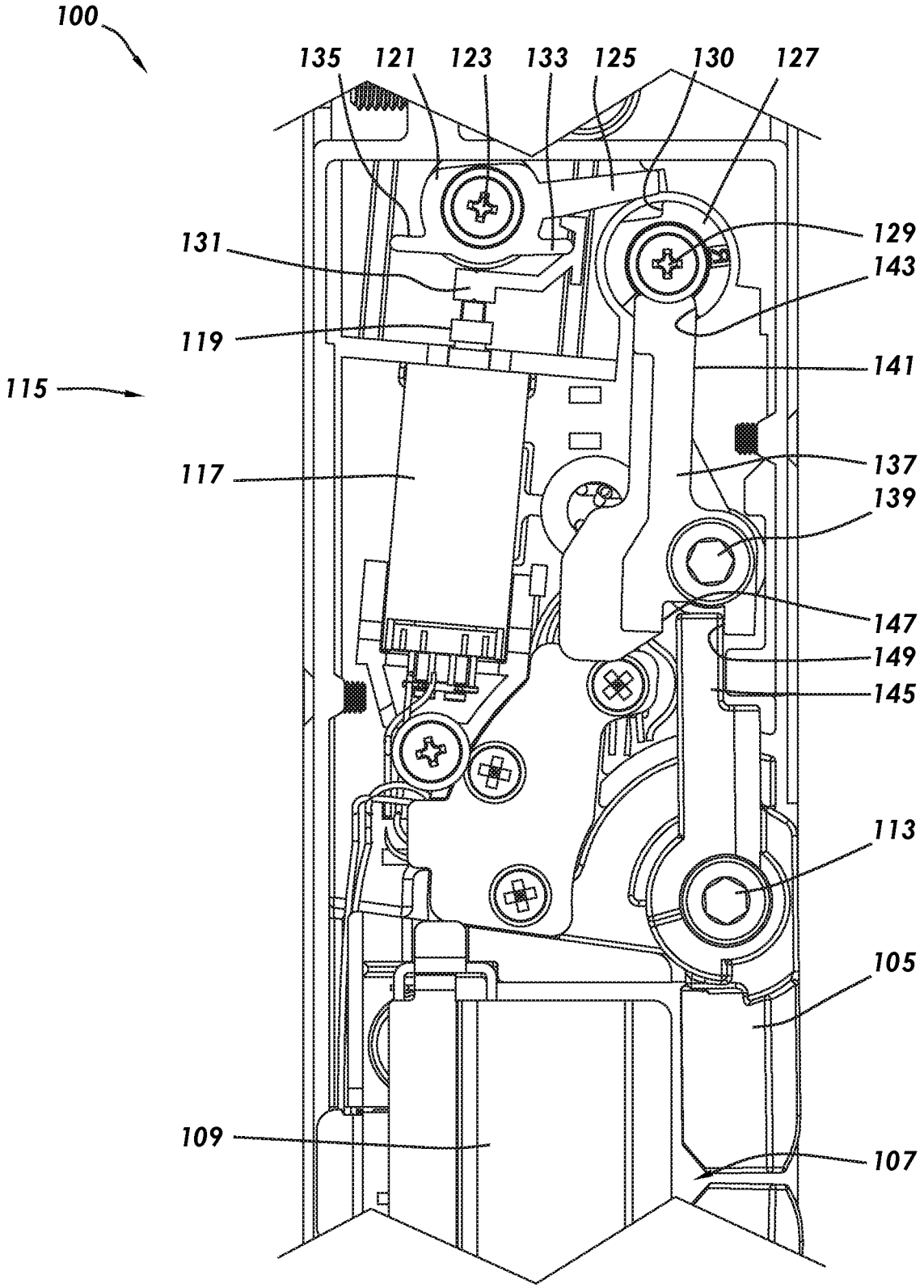
FIGS. 6-10 depict detail views of the rim strike assembly of FIG. 5 during an opening operation.
Figure 7:
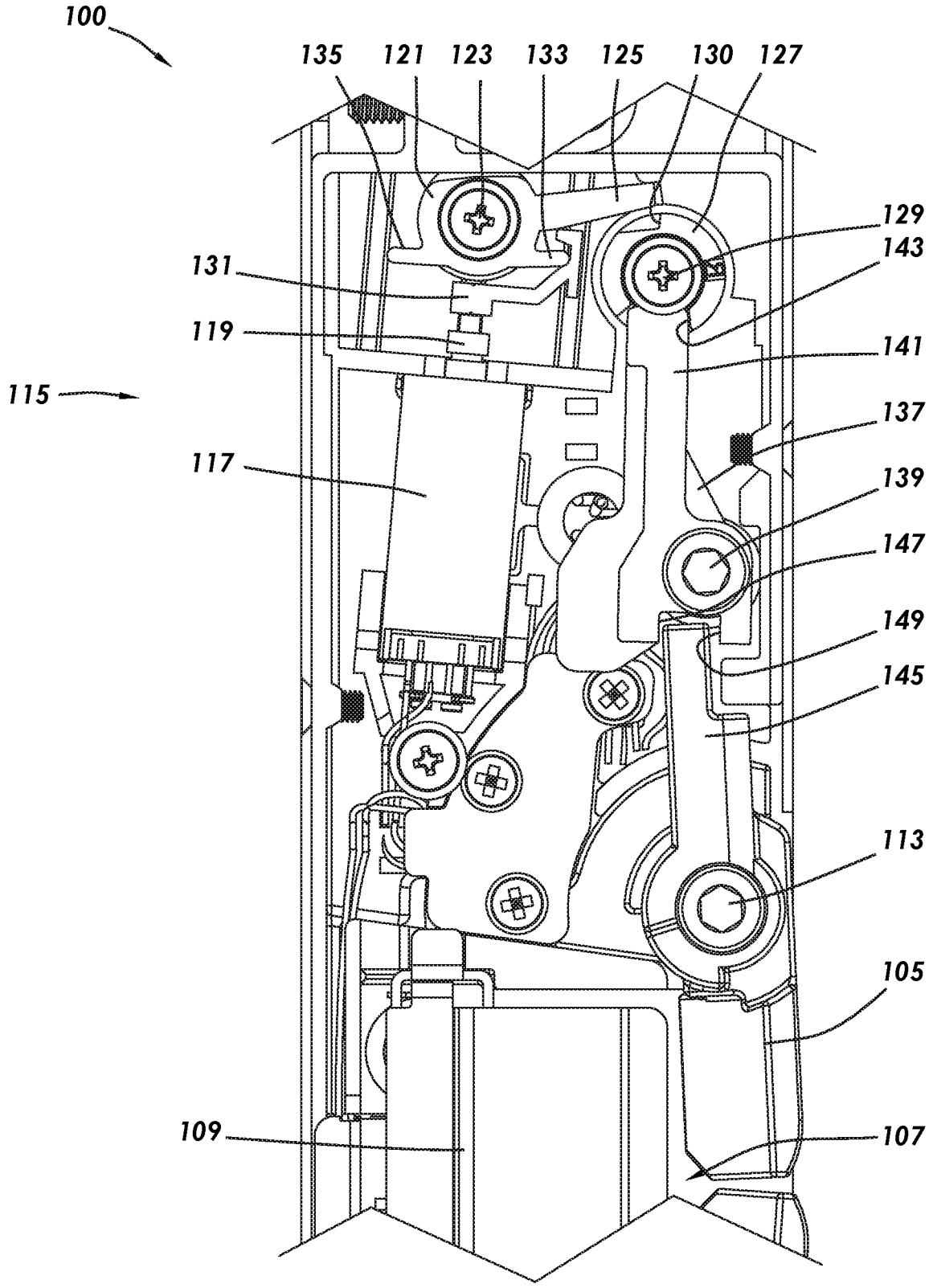
Figure 8:
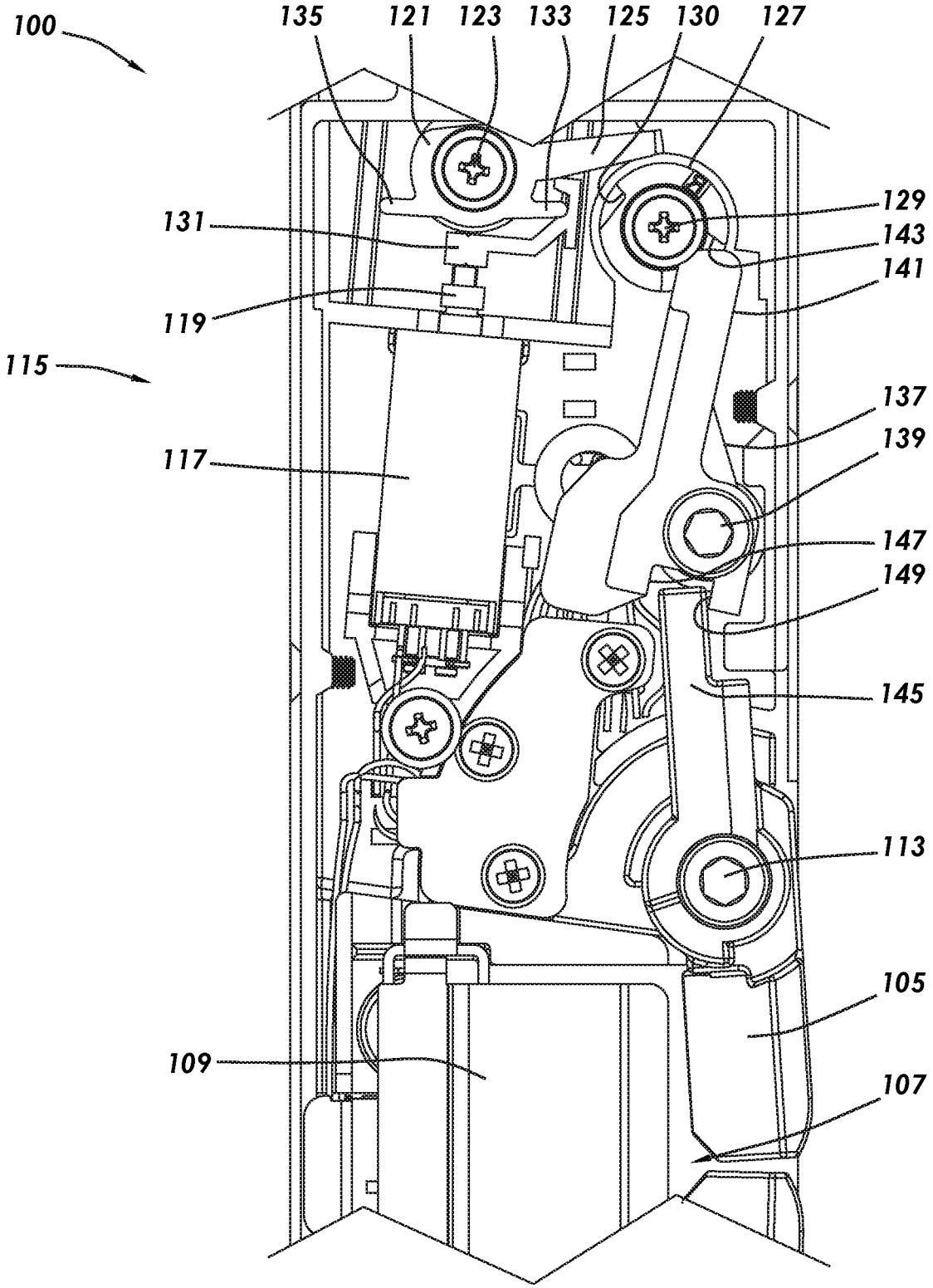

In the event that access through door 20 is desired, solenoid 117 may be electrically energized when rim strike assembly 100 is in the fail-secure configuration (or de-energized when rim strike assembly 100 is in the fail-safe configuration). Plunger 119 may extend (or retract), causing locking clutch 121 to move from the locked position to the unlocked position as shown in FIG. 6. The opening force applied to strike jaw 105 may pivot strike jaw 105 such that jaw follower 145 engages retention face 147 of retaining clutch 137 as shown in FIG. 7. The moment of force applied to strike jaw 105 is thereby transferred to retaining clutch 137. Retaining follower 141 of retaining clutch 137 may engage locking cam 127, thereby transferring the moment of force applied to retaining clutch 137 to locking cam 127. Because locking follower 125 is not engaged to locking cam 127, locking cam 127 rotates, thereby allowing further rotation of retaining clutch 137 and strike jaw 105 as shown in FIG. 8.

Figure 9:
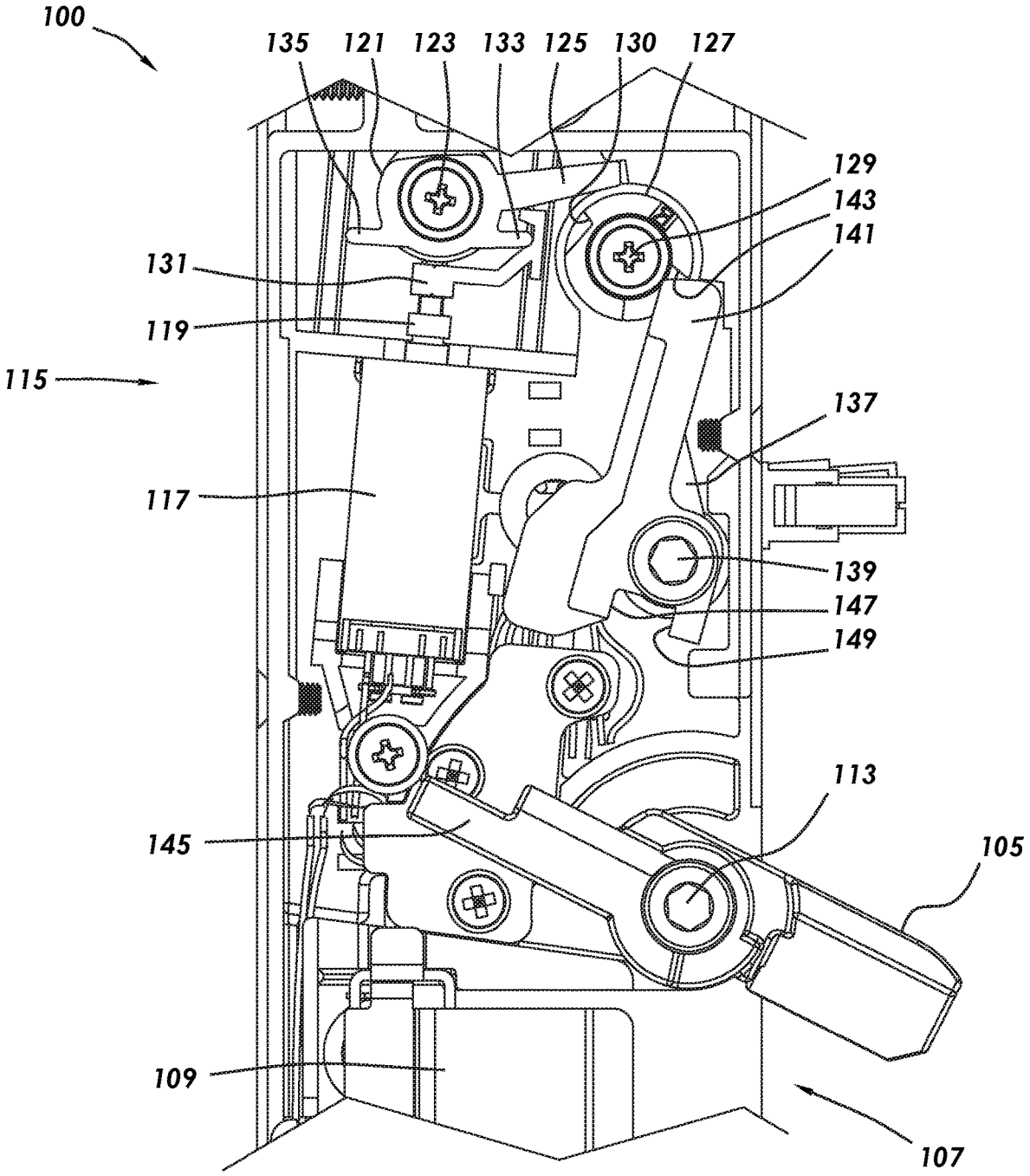

Strike jaw 105, retaining clutch 137, and locking cam 127 continue to rotate until jaw follower 145 and retention face 147 are no longer in alignment, referred to as a release position, at which time strike jaw 105 is able to open unencumbered by actuation linkage assembly 115 in response to the opening force as shown in FIG. 9. In such a position, latch 25 of crash bar 15 of door 20 is able to exit latch cavity 107, and door 20 is able to open.

Figure 10:
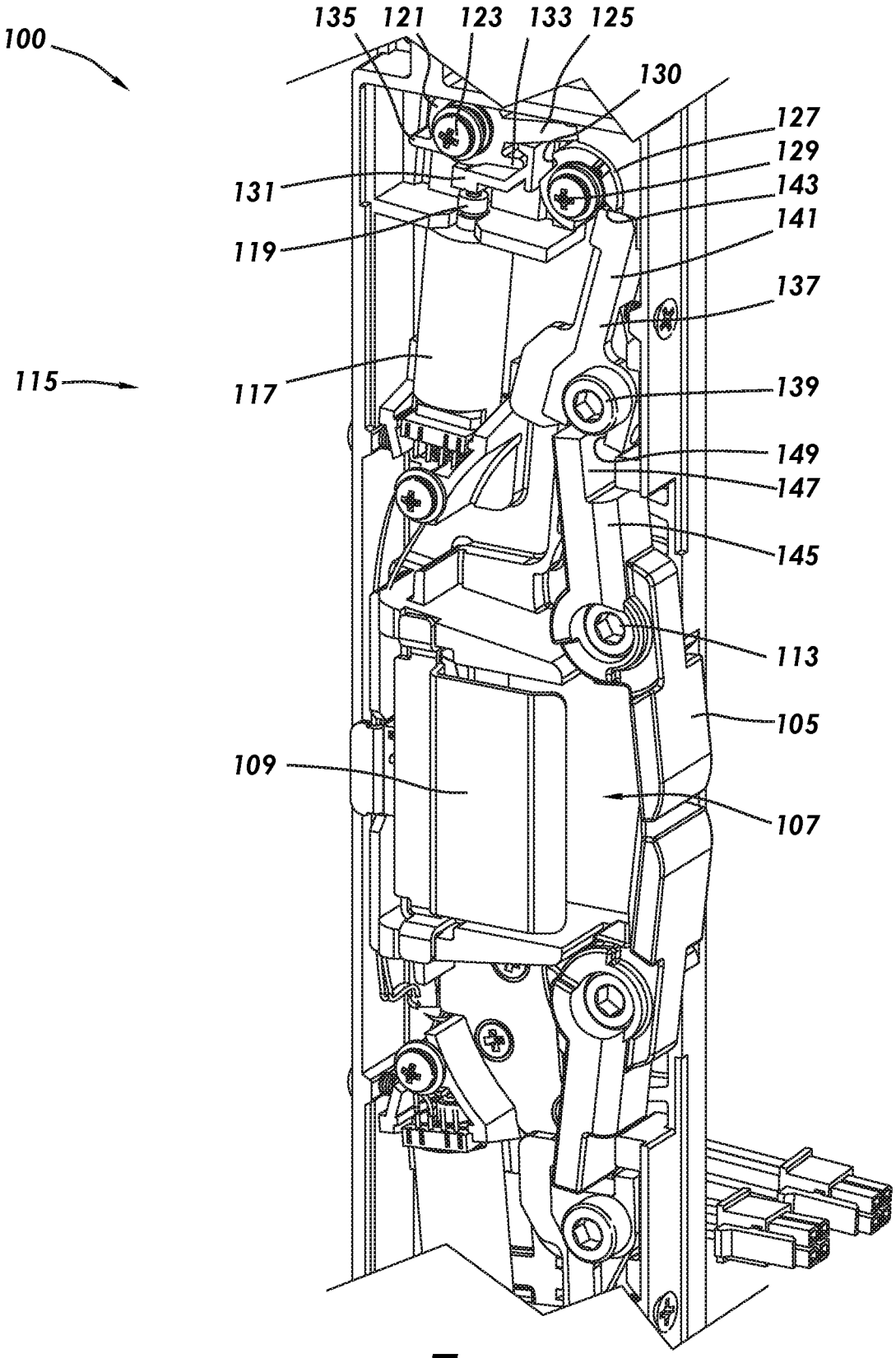

Once latch 25 moves out of engagement with strike jaw 105, the bias force applied to strike jaw 105 may cause strike jaw 105 to pivot toward the closed position. Strike jaw 105 may pivot until jaw follower 145 engages reset face 149 of retaining clutch 137 as shown in FIG. 10. In such an embodiment, continued rotation of strike jaw 105 due to the bias force may cause jaw follower 145 to exert force on reset face 149 of retaining clutch 137, thereby causing retaining clutch 137 to pivot from the release position to the retention position. As retaining clutch 137 moves to the retention position, retaining follower 141 may engage locking cam 127 and cause locking cam 127 to rotate accordingly. In some embodiments, locking clutch 121 may, by deenergizing (or energizing) solenoid 117, pivot to the locked position, thereby engaging locking cam 127 as shown in FIG. 5. Thus, rim strike assembly 100 may be returned to the locked configuration as shown in FIG. 4.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A rim strike assembly comprising:

a strike body;

a strike jaw, the strike jaw pivotably coupled to the strike body, the strike body and strike jaw defining a latch cavity, the strike jaw including a jaw follower, the strike jaw pivotable between a release position and a closed position;

a retaining clutch, the retaining clutch pivotably coupled to the strike body by a retaining clutch pivot pin, the retaining clutch including a retention face, the retaining clutch engaging the jaw follower at the retention face such that an opening force exerted on the strike jaw engages the jaw follower to the retention face, the retaining clutch including a retaining follower;

a locking cam, the locking cam pivotably coupled to the strike body by a locking cam pivot pin, the locking cam including a retaining notch and a locking notch, the retaining follower engaging the retaining notch;

a locking clutch, the locking clutch pivotably coupled to the strike body, the locking clutch including a locking follower, the locking follower engaging the locking notch of the locking cam; and a solenoid, the solenoid including a plunger coupled to the locking clutch such that movement of the plunger rotates the locking clutch from a locked position to an unlocked position;

wherein the retaining follower engages the retaining notch at a distance further from the retaining clutch pivot pin than the distance between the retention face of the retaining clutch and the retaining clutch pivot pin, and wherein the retaining follower engages the retaining notch at a distance further from the retaining clutch pivot pin than the distance between the retaining notch and the locking cam pivot pin such that the moment of force exerted between the locking cam and the locking clutch resulting from the opening force is less than the moment of force applied to the retaining clutch by the strike jaw.

2. The rim strike assembly of claim 1, wherein the strike jaw is biased to the closed position.

3. The rim strike assembly of claim 2, wherein the retaining clutch further comprises a reset face, the reset face positioned such that the bias force on the strike jaw engages the jaw follower to the reset face.

4. The rim strike assembly of claim 1, further comprising a control horn, the control horn mechanically coupled to the plunger of the solenoid, the control horn engaging the locking clutch and adapted to move the locking clutch in response to movement of the plunger.

5. The rim strike assembly of claim 4, wherein the locking clutch further comprises a fail-secure actuating pin, the fail-secure actuating pin and the control horn positioned such that extension of the plunger causes the control horn to move the locking clutch such that the locking follower moves out of engagement with the locking notch of the locking cam.

6. The rim strike assembly of claim 4, wherein the locking clutch further comprises a fail-safe actuating pin, the fail-safe actuating pin and the control horn positioned such that retraction of the plunger causes the control horn to move the locking clutch such that the locking follower moves out of engagement with the locking notch of the locking cam.

7. The rim strike assembly of claim 1, wherein the control horn is pivotably coupled to the plunger such that the control horn is pivotable between a fail-safe configuration and a fail-secure configuration such that when in the fail-safe configuration, extension of the plunger causes the locking follower to move into engagement with the locking notch of the locking cam and such that when in the fail-secure configuration, extension of the plunger causes the locking follower to move out of engagement with the locking notch.

8. The rim strike assembly of claim 1, further comprising an outer cover.

9. A system comprising:

a door, the door including a latch;

a rim strike assembly, the rim strike assembly coupled to a doorjamb, the rim strike assembly positioned to receive the latch when the door is closed, the rim strike assembly including:

a strike body;

a strike jaw, the strike jaw pivotably coupled to the strike body, the strike body and strike jaw defining a latch cavity, the strike jaw including a jaw follower, the strike jaw pivotable between a release position and a closed position;

a retaining clutch, the retaining clutch pivotably coupled to the strike body by a retaining clutch pivot pin, the retaining clutch including a retention face, the retaining clutch engaging the jaw follower at the retention face such that an opening force exerted on the strike jaw engages the jaw follower to the retention face, the retaining clutch including a retaining follower;

a locking cam, the locking cam pivotably coupled to the strike body by a locking cam pivot pin, the locking cam including a retaining notch and a locking notch, the retaining follower engaging the retaining notch;

a locking clutch, the locking clutch pivotably coupled to the strike body, the locking clutch including a locking follower, the locking follower engaging the locking notch of the locking cam; and a solenoid, the solenoid including a plunger coupled to the locking clutch such that movement of the plunger rotates the locking clutch from a locked position to an unlocked position;

wherein the retaining follower engages the retaining notch at a distance further from the retaining clutch pivot pin than the distance between the retention face of the retaining clutch and the retaining clutch pivot pin, and wherein the retaining follower engages the retaining notch at a distance further from the retaining clutch pivot pin than the distance between the retaining notch and the locking cam pivot pin such that the moment of force exerted between the locking cam and the locking clutch resulting from the opening force is less than the moment of force applied to the retaining clutch by the strike jaw.

10. The system of claim 9, wherein the retaining clutch further comprises a retention face, the retention face positioned such that an opening force exerted on the strike jaw engages the jaw follower to the retention face.

11. The system of claim 9, wherein the strike jaw is biased to the closed position.

12. The system of claim 9, wherein the retaining clutch further comprises a reset face, the reset face positioned such that the bias force on the strike jaw engages the jaw follower to the reset face.

13. The system of claim 9, further comprising a control horn, the control horn mechanically coupled to the plunger of the solenoid, the control horn engaging the locking clutch and adapted to move the locking clutch in response to movement of the plunger.

14. The system of claim 13, wherein the locking clutch further comprises a fail-secure actuating pin, the fail-secure actuating pin and the control horn positioned such that extension of the plunger causes the control horn to move the locking clutch such that the locking follower moves out of engagement with the locking notch of the locking cam.

15. The system of claim 13, wherein the locking clutch further comprises a fail-safe actuating pin, the fail-safe actuating pin and the control horn positioned such that retraction of the plunger causes the control horn to move the locking clutch such that the locking follower moves out of engagement with the locking notch of the locking cam.

16. The system of claim 9, wherein the control horn is pivotably coupled to the plunger such that the control horn is pivotable between a fail-safe configuration and a fail-secure configuration such that when in the fail-safe configuration, extension of the plunger causes the locking follower to move into engagement with the locking notch of the locking cam and such that when in the fail-secure configuration, extension of the plunger causes the locking follower to move out of engagement with the locking notch.

17. The system of claim 9, wherein the latch is part of a crash bar.

18. A method comprising:

coupling a rim strike assembly to a door jamb, the rim strike assembly positioned to receive a latch of a door, the rim strike assembly including:

a strike body;

a strike jaw, the strike jaw pivotably coupled to the strike body, the strike body and strike jaw defining a latch cavity, the strike jaw including a jaw follower, the strike jaw pivotable between a release position and a closed position;

a retaining clutch, the retaining clutch pivotably coupled to the strike body by a retaining clutch pivot pin, the retaining clutch including a retention face, the retaining clutch engaging the jaw follower at the retention face, the retaining clutch including a retaining follower;

a locking cam, the locking cam pivotably coupled to the strike body by a locking cam pivot pin, the locking cam including a retaining notch and a locking notch, the retaining follower engaging the retaining notch;

a locking clutch, the locking clutch pivotably coupled to the strike body, the locking clutch including a locking follower, the locking follower engaging the locking notch of the locking cam; and a solenoid, the solenoid including a plunger coupled to the locking clutch such that movement of the plunger rotates the locking clutch from a locked position to an unlocked position;

wherein the retaining follower engages the retaining notch at a distance further from the retaining clutch pivot pin than the distance between the retention face of the retaining clutch and the retaining clutch pivot pin, and wherein the retaining follower engages the retaining notch at a distance further from the retaining clutch pivot pin than the distance between the retaining notch and the locking cam pivot pin;

closing the door such that the latch enters the latch cavity;

applying an opening force to the strike jaw through the latch;

engaging the jaw follower to the retaining clutch;

engaging the retaining follower to the locking cam; and engaging the locking follower with the locking clutch such that the moment of force exerted between the locking cam and the locking clutch resulting from the opening force is less than the moment of force applied to the retaining clutch by the strike jaw.

19. The method of claim 18, further comprising:

rotating the locking clutch from a locked position to an unlocked position wherein the locking follower is out of engagement with the locking cam;

rotating the locking cam, retaining clutch, and strike jaw in response to the opening force; and allowing the latch to exit the latch cavity.

* * * * *